US006179753B1

(12) United States Patent
Barker et al.

(10) Patent No.: US 6,179,753 B1
(45) Date of Patent: Jan. 30, 2001

(54) SUSPENSION SYSTEM FOR EXERCISE APPARATUS

(75) Inventors: Paul D. Barker, Woodinville; Gregory Wing, Carnation; Paul Stevens, Yakima, all of WA (US)

(73) Assignee: Illinois Tool Works Inc., Glenview, IL (US)

( * ) Notice: Under 35 U.S.C. 154(b), the term of this patent shall be extended for 0 days.

(21) Appl. No.: 09/441,491

(22) Filed: Sep. 20, 1999

Related U.S. Application Data

(63) Continuation-in-part of application No. 29/094,989, filed on Oct. 14, 1998.

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 6,050,922 * 4/2000 Wang ..... 482/54
6,110,076 * 8/2000 Hurt ..... 482/54
6,123,648 * 9/2000 Stevens ..... 482/54

* cited by examiner

*Primary Examiner*—Glenn E. Richman
(74) *Attorney, Agent, or Firm*—Christensen O'Connor Johnson Kindness PLLC

(57) ABSTRACT

A treadmill (10) includes a frame (12) on which are mounted transverse forward and rearward roller assemblies (16, 18). An endless belt (20) is trained about the forward and rearward roller assemblies. A deck (24) is positioned between the upper run of the belt and the frame. The rearward portion of the deck (24) is hinged to the frame by pivot brackets (70) mounted to the frame to allow pivoting of a deck about an axis extending transversely to the length of the deck. Preferably, the pivot bracket (70) is of unitary construction, but of sufficient flexibility to allow the relatively free pivoting of the rear portion of the deck in relationship to the frame. Elastomeric cushions or springs are supported by the forward portion of the frame to underlie and support the forward portion of the deck and to absorb impact loads imparted on the deck by the user. A pivot wall (90) extends downwardly from the rear portion of the frame (12) to support the rear of the deck and also to raise and lower the rear of the treadmill deck relative to the forward end of the treadmill deck, thereby to provide an adjustable incline for the deck.

23 Claims, 6 Drawing Sheets

SUSPENSION SYSTEM FOR EXERCISE APPARATUS

CROSS REFERENCE TO RELATED APPLICATION

The present invention is a continuation-in-part of Ser. No. 29/094,989, filed Oct. 14, 1998.

TECHNICAL FIELD OF THE INVENTION

The present invention relates to exercise equipment, and more particularly to exercise treadmills, and still more particularly to a suspension system for supporting the deck of the exercise treadmill above an underlying frame structure.

BACKGROUND OF THE INVENTION

Exercise treadmills are widely used in spas, exercise clubs and also in individual residences to enable users to walk, jog or run indoors. This is especially useful during inclement weather and also at night or at other times when exercisers do not desire to run outdoors. Most exercise treadmills include first and second roller assemblies that are transversely mounted at the ends of a frame. An endless belt is trained about the roller assemblies. The upper run of the belt is supported by an underlying deck positioned between the belt and the frame.

Efforts have been made to reduce the impact on the user's limbs and joints when jogging or running on a treadmill. One method of reducing the impact on an exerciser's body is disclosed by U.S. Pat. Nos. 4,974,831 and 4,984,810. In the treadmills disclosed by these patents, the rear end of the deck is pivotally mounted to the frame, with the forward end of the deck supported by a suspension system. In the '831 patent, the suspension system consists of a fairly complicated lever arm assembly and cooperating shock absorbers. Striding on a deck results in pivoting of the lever arms and extension of the shock absorbers, thereby to dampen the impact of the user's feet. A drawback of this shock absorption system is its complex nature, rendering it costly to manufacture.

In the '810 patent, the forward end of the treadmill deck was supported by a conventional compression spring and separate shock absorber. Placement of the spring and shock absorber at the very front of the deck imposes considerable bending stress on the deck.

Other conventional treadmills have utilized rubber blocks positioned between the deck and the underlying frame to absorb impact. One such conventional treadmill is disclosed in French Patent No. 2,616,132. A treadmill deck is mounted above the frame members on a plurality of flexible pads. Bushings are inserted into the top and bottom of each pad, and bolts depending downwardly from the deck and upwardly from frame are received within the corresponding bushings. The bolts serve to position the flexible pads between the deck and frame for shock absorption.

U.S. Pat. Nos. 5,336,144 and 5,454,772 disclose a deck supported above a frame by a plurality of cup-shaped elastomeric springs. The elastomeric springs reversibly deform during downward deflection of the deck toward the frame. The elastomeric springs have side walls of tapering thickness. As a result, the resistance to the downward travel of the deck provided by the elastomeric springs is proportional to the degree of deflection of the deck toward the frame. One drawback of this particular treadmill construction is that the elastomeric springs are fixed in place and individually define a rather small bearing area.

SUMMARY OF THE INVENTION

The present invention provides an exercise treadmill having a frame, forward and rearward roller assemblies rotatably mounted on the frame, and an endless belt trained about the forward and rearward roller assemblies. The exercise treadmill also includes a deck disposed between the frame and the upper run of the belt. A pivot bracket pivotally connects the rearward end portion of the deck to the frame. Elastomeric spring members are disposed between the frame and the deck at a location intermediate the ends of the deck to support the deck relative to the frame. The elastomeric springs reversibly deform to resist deflection (downward movement) of the deck toward the frame when the exerciser strides on the endless belt. The resistance provided by the elastomeric spring members is proportional to the extent of deflection of the deck.

In a further aspect of the present invention, the pivot bracket includes a body portion mounted to the treadmill frame and a top flange extending transversely from the body portion and connectable to the rear portion of the treadmill deck. The top flange of pivot bracket is integrally formed with the body portion and connects to the body portion along a flexible juncture.

In a further aspect of the present invention, a pivot bracket is located at each side of the rear portion of the frame, with the top flange of the pivot bracket underlying the bottom surface of the treadmill deck. More specifically, the treadmill frame includes side rails, and the body portion of the pivot bracket is fixedly attached to the frame side rails.

In a further aspect of the present invention, a lift mechanism is utilized to raise and lower the rear of the treadmill relative to the front of the treadmill. Such lift mechanism includes a pivot wall pivotally attached to the rear portion of the treadmill frame and extending downwardly therefrom to support such treadmill frame rear portion. An actuator link is operable to pivot the pivot wall about a transverse axis, thereby to raise and lower the rear portion of a treadmill relative to the forward portion of the treadmill.

In a more specific aspect of the present invention, the upper portions of the pivot wall are pivotally coupled to a cross member that interconnects the pivot brackets. Also, the actuating link is powered to automatically raise and lower the rear portion of the treadmill relative to the forward portion.

In a further aspect of the present invention, the forward roller assembly is powered by an electric motor positioned beneath the forward portion of the treadmill deck. This leaves the forward portion of the treadmill deck unobstructed, thereby allowing the user to stride closer to the forward end of the treadmill deck than in conventional treadmills, wherein the drive motor is positioned above the treadmill deck.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
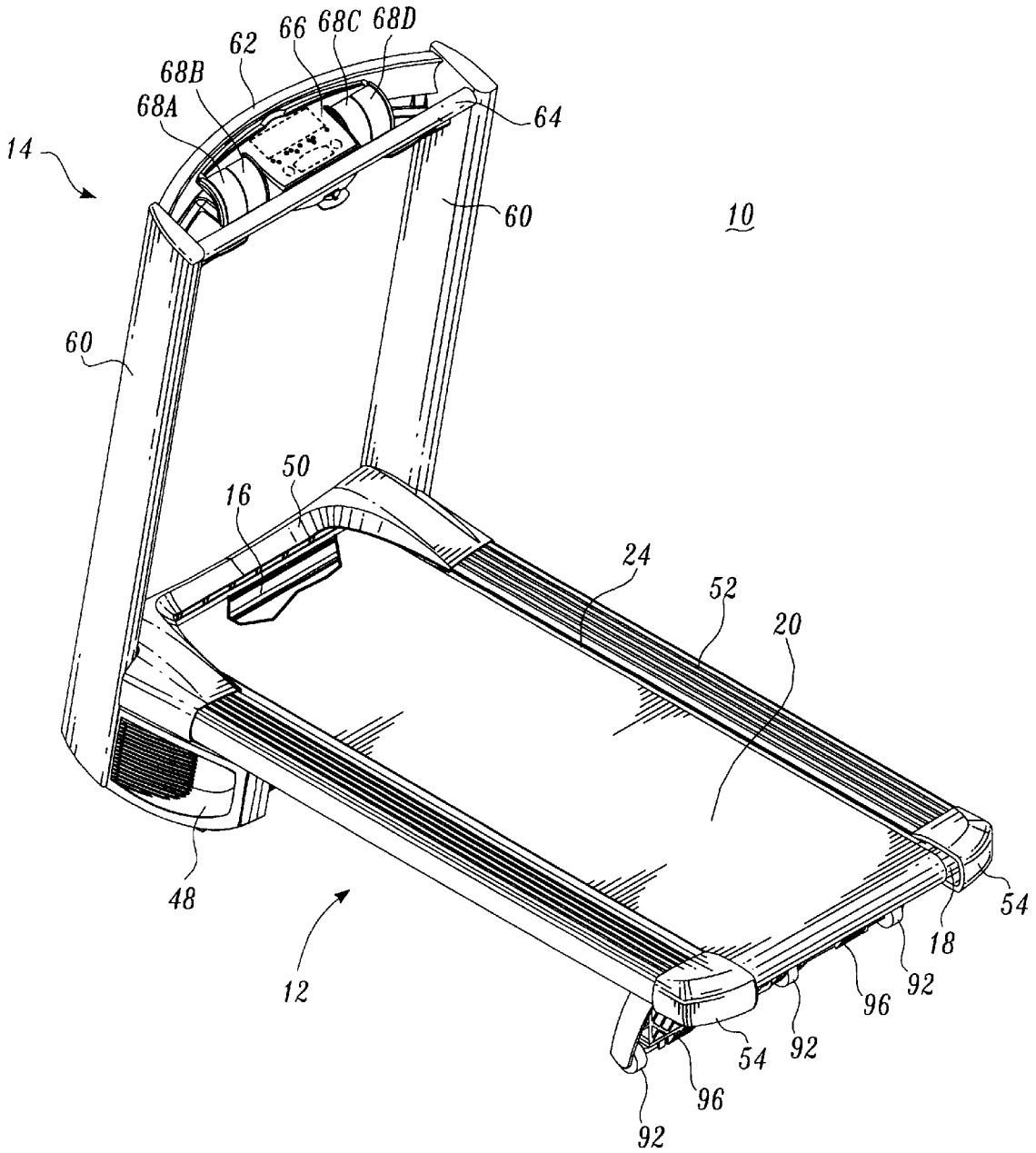
FIG. 1 is a rear isometric view of the exercise treadmill construction in accordance with the present invention.

A treadmill 10 constructed in accordance with the present invention includes a frame 12, a forward upright structure 14 extending upwardly from the forward end of the frame. A forward roller assembly 16 and a rearward roller assembly 18 are transversely mounted on the frame. For purposes of the present invention, including the claims herein, the designation "forward end" refers to the direction in which the exerciser faces when using the treadmill 10. The terms "rear" and "forward" refer to opposite directions. An endless belt 20 is trained about the forward and rearward roller assemblies 14 and 16. The belt is powered by an electrical motor drive system 22 located beneath a deck 24, which is positioned between the upper run of the belt 20 and the frame 12. A lift mechanism 26 raises and lowers the rear end portion of the treadmill relative to the forward end portion.

Describing the foregoing aspects of the present invention in greater detail, the frame 12 includes a pair of longitudinal, side beams 30 that are disposed in laterally spaced apart, parallel relationship to each other by a forward undercarriage structure 32. Preferably, the side beams 30 are of hollow construction and are of closed or substantially closed square or rectangular cross section. The side beams may be formed by various techniques, such as by bending or rolling or by extrusion. Alternatively, the side beams may be of preformed tubular stock. The box beam construction provides substantial rigidity per unit weight of the side beams.

The undercarriage 32 includes formed side members 34 that extend downwardly from the forward end portion of the side beams 30. When viewed from the side of the frame 30, the side members 34 taper downwardly to define a generally trapezoidal shape. A square-shaped cross beam 36 spans transversely across the undercarriage to intersect the lower, forward portions of the side members 34. Also, a rectangularly shaped cross beam 38 spans transversely across the rear upper corners of the side members 34 to add rigidity to the frame structure. A formed support member 40 extends along a forward portion of the frame side beams 30, as shown in FIG. 8.

A support member 40 includes a vertical or upright web wall 42 that overlies the top surface of the cross member 38 and is supported thereby. The support member also includes a horizontal shelf 44 that extends transversely from the upper portion of the web 42 to intersect with the lower edge portion of side beams 30, thereby to define a surface or shelf for receiving a compressible elastomeric cushion or spring 43 for supporting the adjacent portion of the treadmill deck. As shown in FIG. 10, the support member 40 also includes tabs 45 that extend upwardly from the side edges of shelf 44 and then extend a short distance inwardly to overlie and capture the flange portions 46 of cushion 43.

Figures 8, 10:
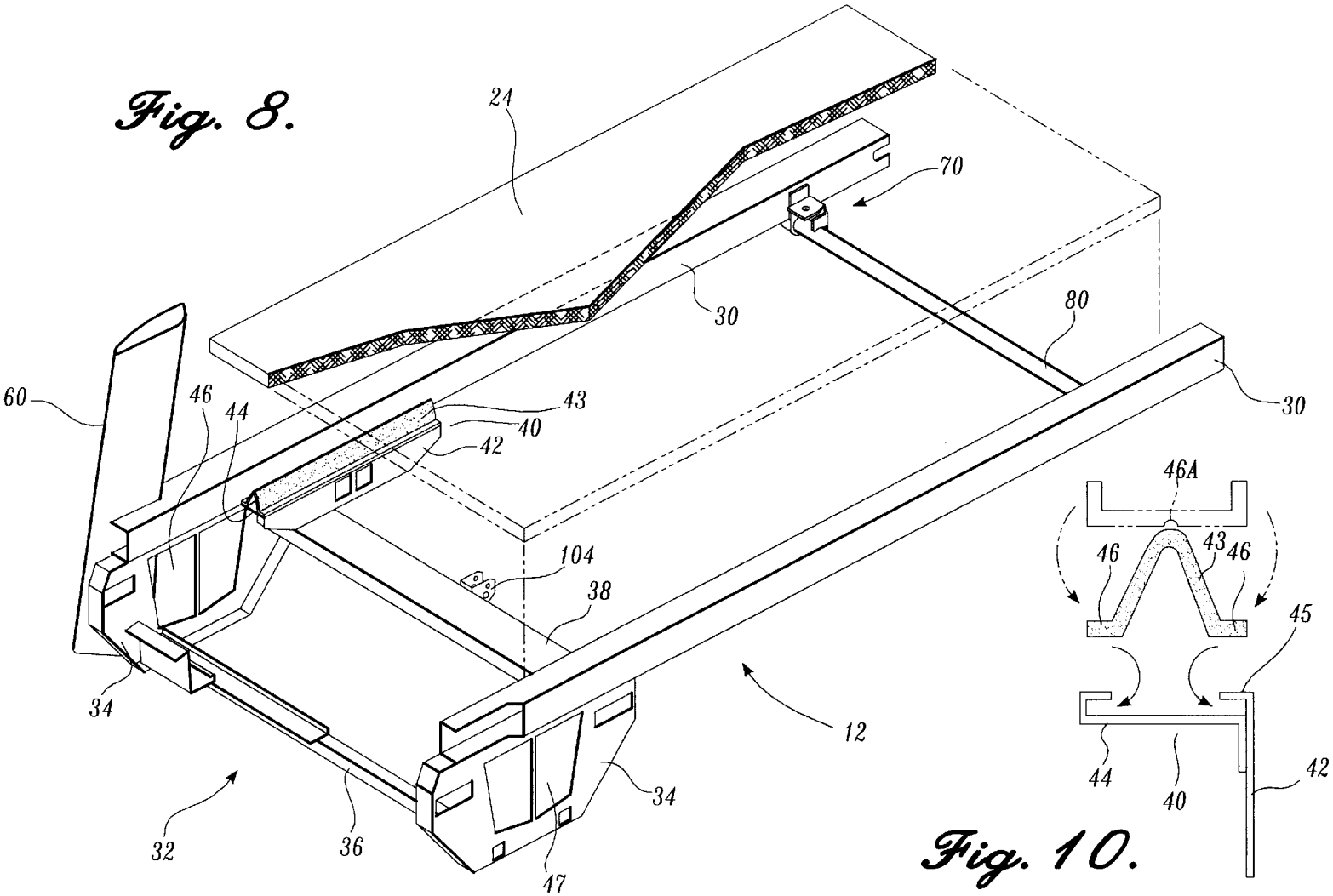
FIG. 8 is a pictorial view of the frame, a portion of the deck and a pivot bracket of the exercise treadmill of FIG. 1.
FIG. 10 is an enlarged, cross-sectional view of a portion of FIG. 8.

As shown in FIG. 10, the elastomeric cushion/spring 43, when installed on support member 43, has generally an upside-down V-shaped configuration in cross section. However, in nominal configuration (before being installed on support member 40) the cushion/spring 43 is substantially planar, with the flange portions 46 extending nominally upwardly from the horizontal ends of the flattened cushion/spring. A shallow depression or undercut 46*a* extends longitudinally centrally along the surface of the cushion/spring 43 opposite to the direction in which the flanges 46 project from the cushion/spring. This undercut helps to ensure that the cushion/spring bends at the desired shape when the spring is folded from its nominal uninstalled position to the installed position on support member 40. When installed, the cushion/spring in cross section forms a downwardly concave, generally V-shape which is capable of supporting the forward portion of the treadmill deck 24 as well as resiliently deflecting downwardly during footfall of the treadmill user. Preferably the cushion/spring is composed of a rubber, synthetic rubber or rubber composite material that is resiliently compressible and/or deformable, as well as durable. Such materials are commercially available.

As noted above, the motor 22 used to power the forward roller assembly 16, is housed within the undercarriage 32. The required electrical transformer, not shown, and the motor control elements are also housed within the undercarriage 32. As shown in FIG. 8, the side members 34 of the undercarriage have relatively large openings 47 formed therein to allow air to circulate in and out of the undercarriage. The opening is covered by a grill assembly 48 having a series of horizontal fins to prevent entry into the undercarriage by foreign objects while allowing air to pass in and out of the undercarriage.

It will be appreciated that by placing the motor 22 beneath the deck 24, there is no obstruction in front of the belt 20 as in a typical treadmill. In a typical treadmill, a hood is positioned at the front of the treadmill frame to extend upwardly from the belt a substantial height. If the user gets too close to the hood, his/her feet could kick the hood thereby resulting in potential injury. As such, in a typical treadmill, the user must stay substantially rearwardly of the hood. In the present situation on the other hand, the front of the belt is substantially opened, with a formed, generally U-shaped, low-lying cover 50 extending across the front edge of the frame and rearwardly a short distance along the top of the frame side beams 30 to overlie formed, side, longitudinal covers 50 that extend along the upper surface, outside surface and part of the bottom surface of the side beams 30. Formed rear comer caps 54 cover the rear ends of the frame side beams 30 and the ends of the rear roller assembly 18.

Figure 2:
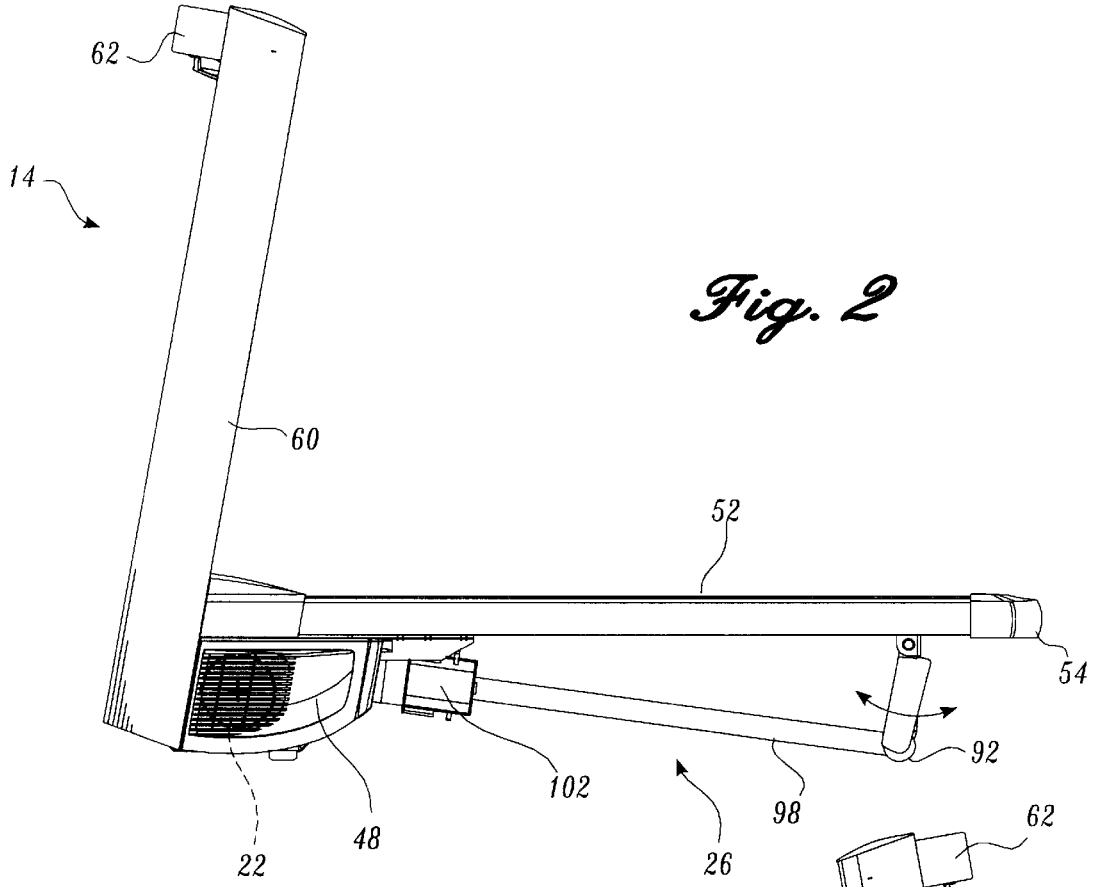
FIG. 2 is a side view of FIG. 1.
Figure 3:
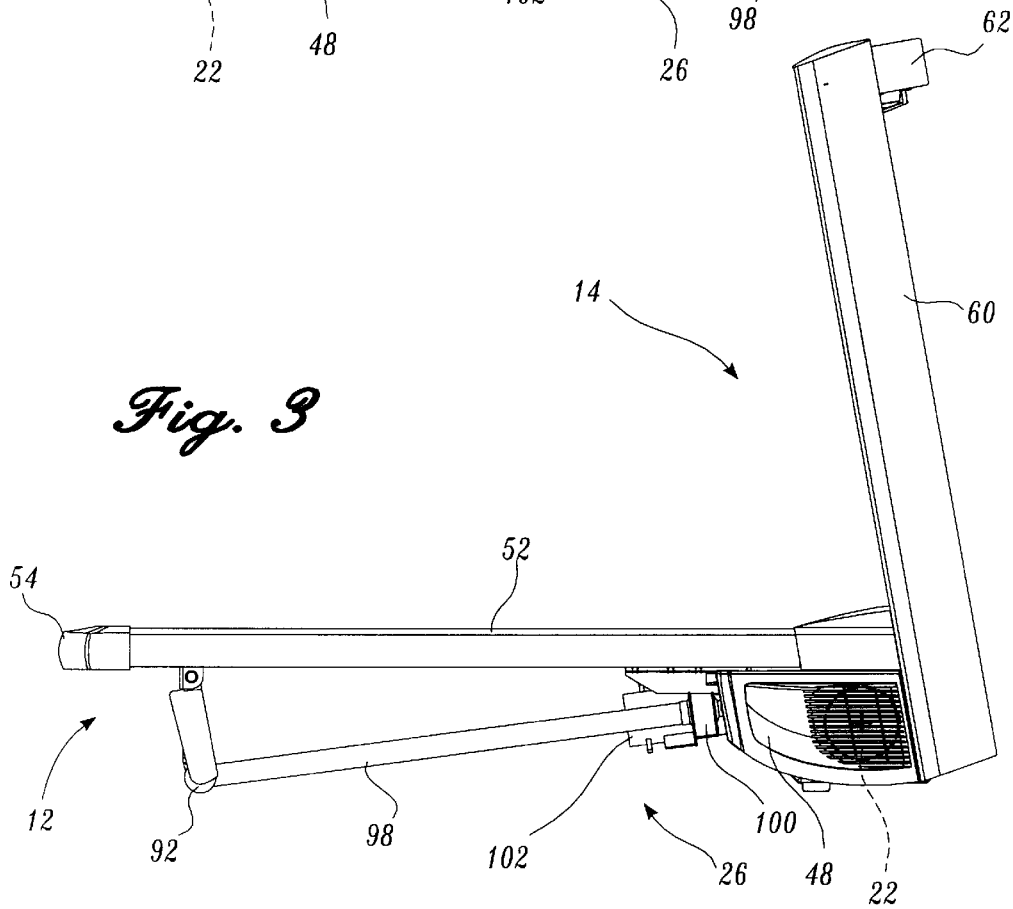
FIG. 3 is a side view of FIG. 1 taken from the side of FIG. 1 opposite to that shown in FIG. 2.
Figure 4:
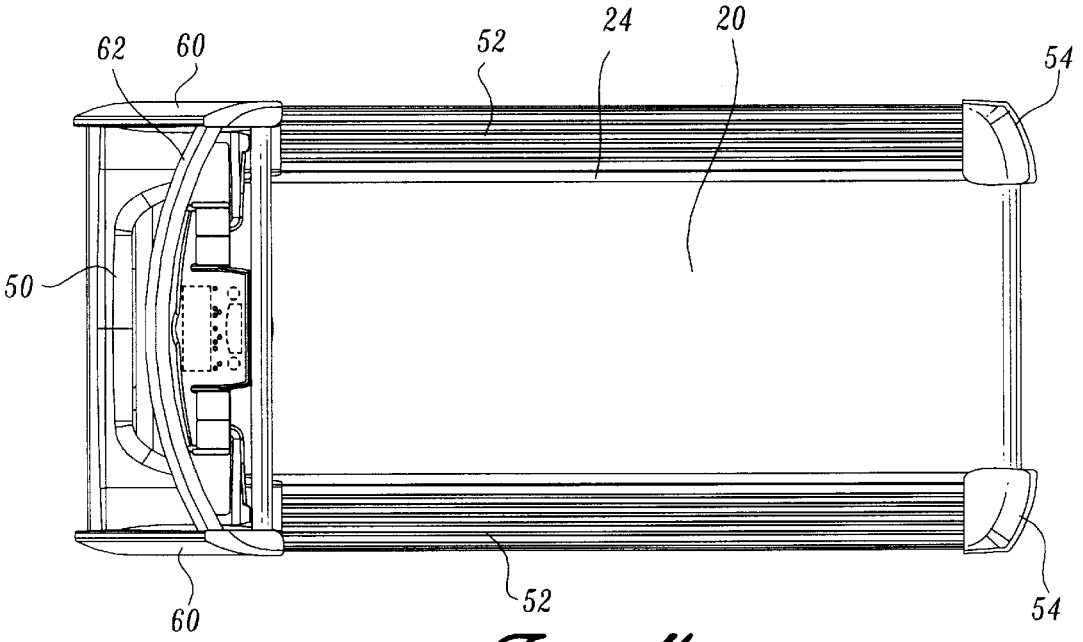
FIG. 4 is a top view of FIG. 1.
Figure 5:
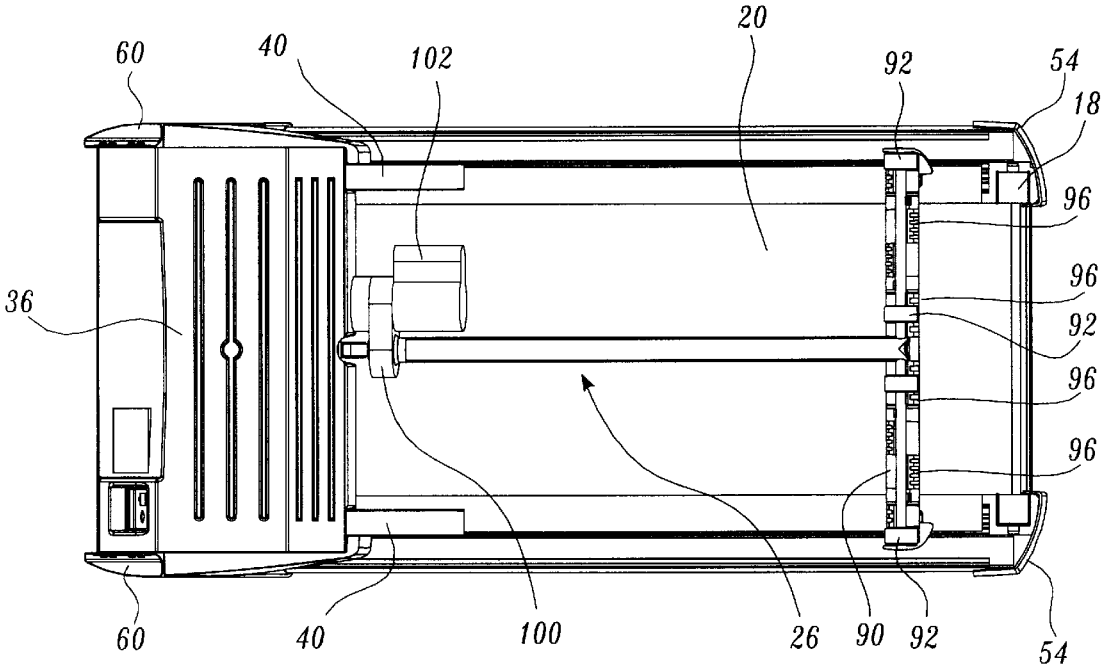
FIG. 5 is a bottom view of FIG. 1.
Figure 7:
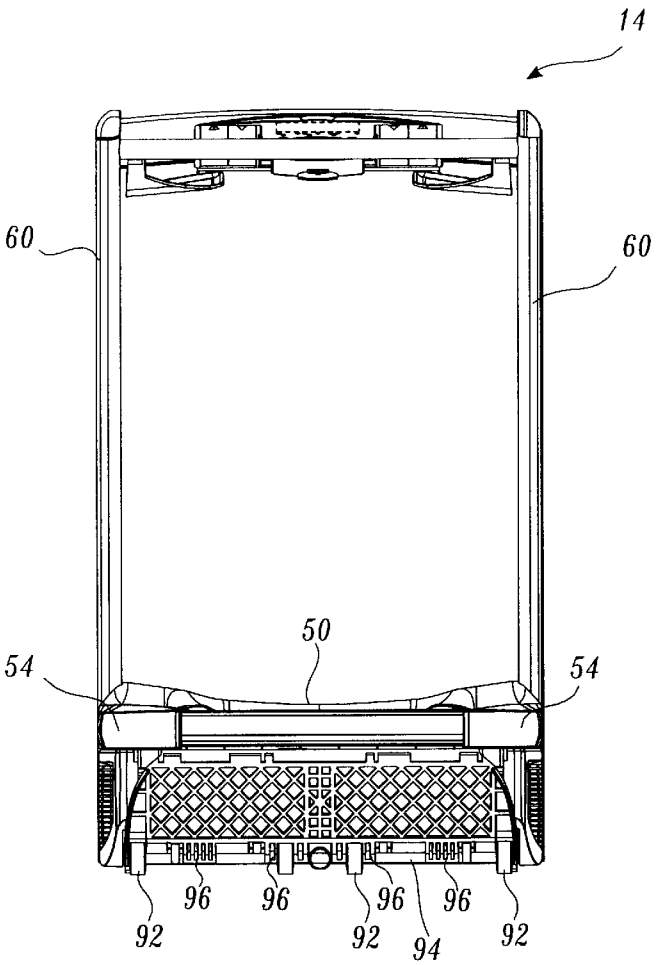
FIG. 7 is a rear view of FIG. 1.
Figure 6:
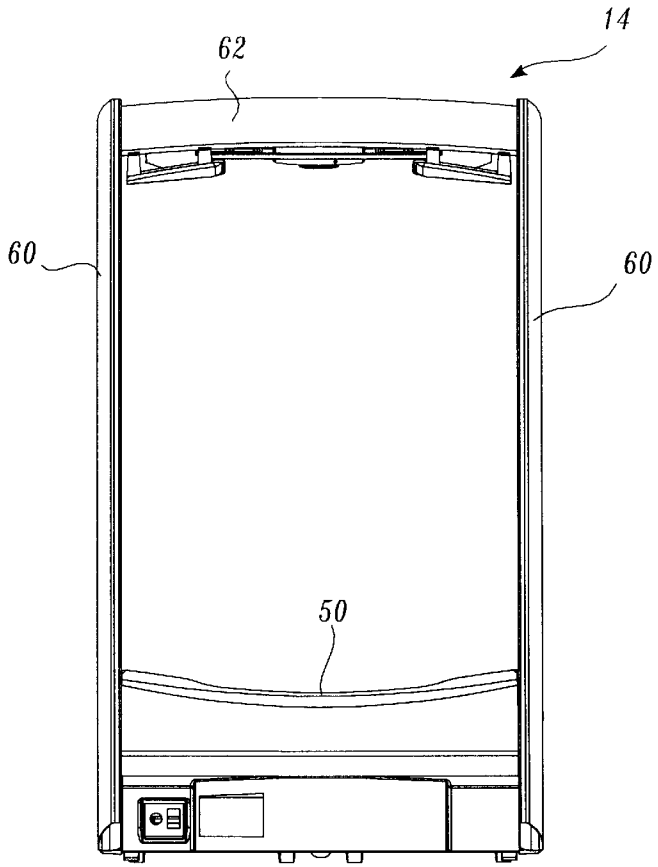
FIG. 6 is a front view of FIG. 1.

The upright structure 14 is composed of a pair of sideposts 60 that extend upwardly from the forward comers of the frame 12 in spaced parallel relationship to each other. As shown in FIGS. 2 and 3, the sideposts 60 extend upwardly and slightly rearwardly. Ideally, the sideposts are composed of formed tubular members that are generally rectangular in cross section, though tapered somewhat in the forward direction. A forwardly convex cross member 62 interconnects the upper forward comers of the sideposts 60, and a straight, tubular cross member 64 interconnects the upper rear comers of the sideposts. The rear cross member 64 is sized to be readily graspable by the user, thereby to serve as a handlebar for the user. A display and control panel 66 is supported by the forward cross member 62 as are sets of curved manually depressible control "buttons" 68A, 68B, 68C and 68D. The control buttons could control various functions of the treadmill, including the belt speed and the incline of the treadmill.

Figure 9:
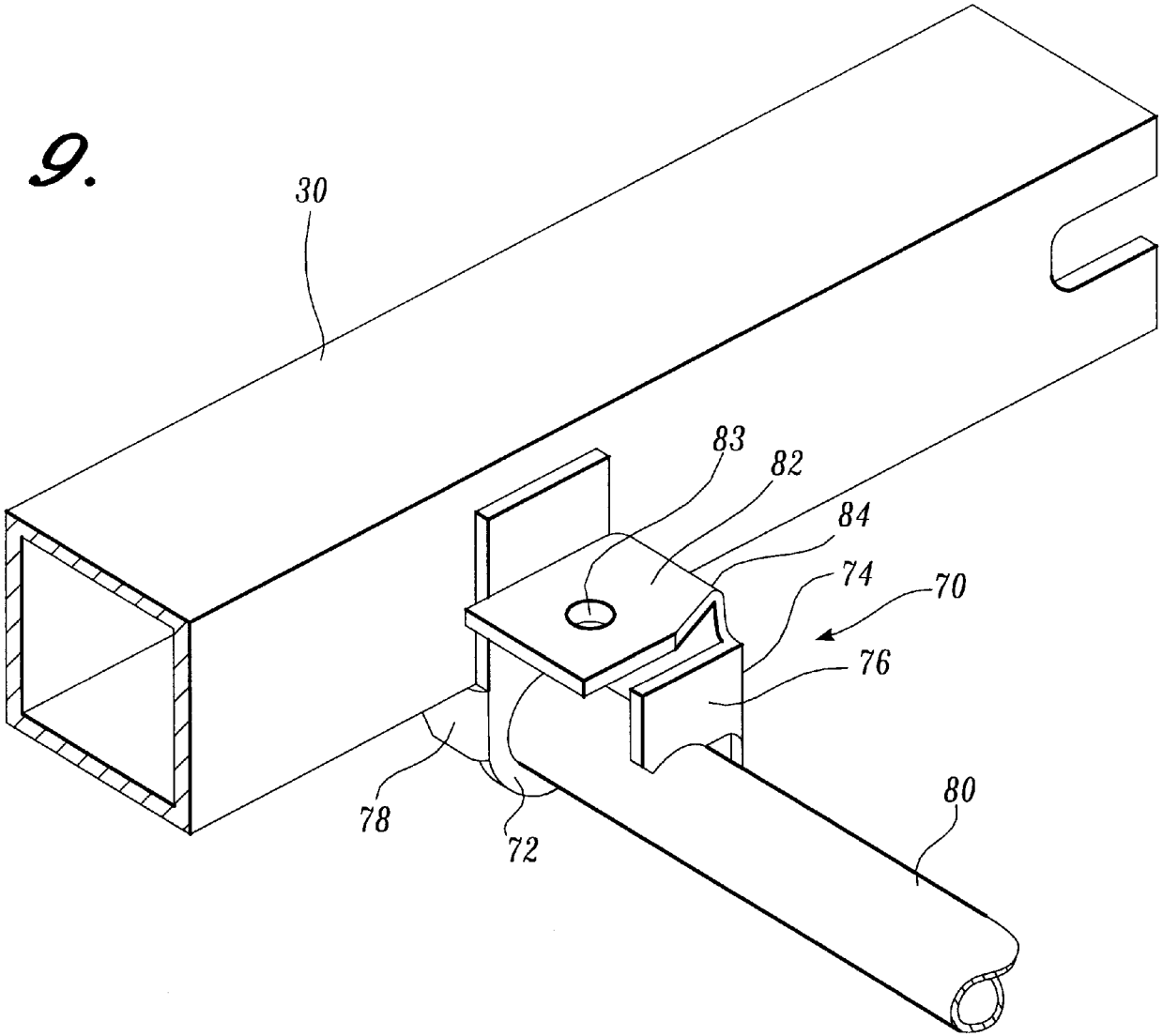
FIG. 9 is an enlarged fragmentary pictorial view of a portion of FIG. 8.

Referring primarily to FIGS. 8 and 9, the rear portion of deck 24 is pivotally hinged to frame 12 by a pair of pivot brackets 70 mounted on the rear portions of the frame side beams 30. The pivot brackets 70 include a lower box portion composed of an outside wall 72 that partially overlaps the adjacent wall of the side beam 30, a transverse rear wall 74 and an inside wall 76 in substantially spaced parallel relationship with the outside wall 72. A forward tab 78 extends transversely from the forward edge portion of outside wall 72 to underlie the lower edge of the frame side beam 30. Although tab 78 does help enhance the rigidity of bracket 70, it is not deemed essential to the present invention. A tubular cross member 80 spans between the opposite outside walls 72 of the two pivot brackets 70 to serve as a rear cross member for the frame 12. In addition, the lower edge of the inside wall 76 of the pivot bracket 70 is fixedly secured to the upper surface portion of the cross member 80, thereby to add substantial rigidity to the box portion of the pivot bracket.

The pivot bracket 70 also includes a top flange 82 that is secured to the underside of the treadmill deck 24 by any convenient method; for example, a hardware member can extend upwardly through the opening 83 formed on flange 82 to engage with a threaded insert embedded into the deck 24.

As a further example, the treadmill deck may be secured to the pivot bracket by a hardware member extending downwardly through a clearance hole (not shown) formed in the deck to engage opening 83, which may be threaded. Alternatively, opening 83 may be sized as a clearance hole, with a threaded nut, not shown, secured to the underside of top flange 82. In this alternative, preferably the top surface of the treadmill deck has a counterbore to accommodate the thickness of the head of the bolt or other hardware member extending downwardly therethrough so as not to rub against the underside of the endless belt 20.

The top flange 82 is integrally formed with the box beam portion of the pivot bracket 70 and is flexibly attached to the box beam portion by a rear corner joint 84. It will be appreciated that by the foregoing construction, the rear end portion of the treadmill deck 24 is not only vertically and laterally supported and constrained, but also "hinged" to the frame 12 to allow the rearward portion of the treadmill deck to pivot relative to the frame 12 about a transverse axis corresponding to bracket corner joint 84. As will be appreciated, the pivot bracket 70 provides an inexpensive, but effective and durable hinge or pivot connection between the treadmill deck 24 and the frame 12.

Ideally the pivot bracket is composed of a unitary structure that has been formed or fabricated to the configuration described above. In this regard, the pivot bracket can be formed from high-strength material that is capable of repeatedly flexing at corner joint 84 without fatiguing. Various types of steel alloys (and even some high-strength plastics) meet these requirements.

The pivot bracket 70 can be of other structures without departing from the spirit or scope of the present invention. For example, a rectangular or other shaped cross member could extend transversely between the side beams 30, and the pivot brackets 70 could be attached to such cross member, for instance, along the rear wall 74 of the pivot bracket. In such construction, the pivot bracket 70 need not necessarily be tied to the frame side beams 30. In such case, the pivot bracket 70 may not necessarily include an outside wall 72 nor an inside wall 76, but simply a rear wall 74 and a top flange 82.

The lift mechanism 26 of the present invention preferably includes a pivot wall 90 that supports the rear end portion of the treadmill 10. As shown in FIGS. 1–3, 5 and 7, the upper edge portion of the pivot wall 90 is pivotally coupled to the tubular cross member 80 to extend downwardly therefrom. A series of rollers 92 are engaged over a transverse axle 94 that extends through openings formed in tabs 96 extending downwardly from the lower edge portion of the pivot wall 90. The pivot wall 90 can be of numerous constructions, including as a solid member, of hollow construction, or as a relatively thin member with reinforcing ribs.

It will be appreciated that the orientation of the pivot wall relative to the cross member 80 may be varied, thereby to raise and lower the rear portion of the frame 12, and thus also the deck 24, thereby to change the incline of the deck. This is accomplished through the use of an actuating link or rod 98 that is secured at its rearward end to axle 94 and connected at its forward end to a screw mechanism 100 that is powered by an electric motor 102 which serves to automatically raise and lower the pivot wall 90 as desired. The screw mechanism is coupled to a double ear mounting bracket 104 that extends rearwardly from the center of front cross member 38. The operation of the electric motor 102 can be controlled by buttons 68 of the control/display panel 66, discussed above. It will be appreciated that other methods could be used to operate the pivot wall 90. In addition, the rear end of the treadmill 10 could be raised and lowered by other methods.

One of the unique features of the present invention is that very little of the impact loads imposed on the treadmill deck by the user is required to be carried by the side beams 30, unlike in existing treadmills having decks that are cushioned relative to the underlying treadmill frame. At the front portion of the deck 24, the load imposed on the deck is transmitted downwardly to elastomeric cushion/spring 43, then to the support member 40 on which the elastomeric cushion/spring is mounted. The load is then transmitted to cross member 38, then downwardly to undercarriage side members 34, and then to the ground or floor. In a conventional treadmill, the front portion of the deck is primarily supported by the frame side rails.

At the rear of deck 24, the load imposed on the deck by the user is transmitted downwardly to pivot bracket 70 and then to tubular cross member 80. From the tubular cross member 80 the load is transmitted downwardly to pivot wall 90 and then to the floor or ground through rollers 92. Thus, very little of the load extending downwardly from the rear of the treadmill deck is carried by the rear portion of the side beams 30. As a consequence, the frame 12 very efficiently transmits the loads and forces imposed on deck 24 to the floor or ground through a minimum of components and without significant reliance on the frame side beams 30. As such, the side beams 30 do not have to be constructed as robust as in a typical treadmill in which primarily all the deck loads are transmitted first to the frame side beams and then downwardly to the ground. In the present invention the side beams can be constructed from thin-gauge mild steel, for example of a thickness of 0.065 inch.

The present invention has been described above in terms of a preferred embodiment and several variations thereof. It is to be understood that other modifications, alterations, and substitutions are possible within the scope of the present invention. It is thus intended that the scope of the Letters Patent granted hereon is to be limited only by the appended claims.

The embodiments of the invention in which an exclusive property or privilege is claimed are defined as follows:

1. An exercise treadmill comprising:

(a) a frame;

(b) first and second roller assemblies operably mounted on the frame;

(c) an endless belt trained about the first and second roller assemblies;

(d) a deck disposed between the frame and the upper run of the endless belt, the deck having a first end portion and a second end portion;

(e) at least one pivot bracket to pivotally connect the second end portion of the deck to the frame to pivot about an axis extending generally transversely to the length of the deck; and (f) at least one elastomeric spring disposed between the frame and the deck at a location between the first and second end portions of the deck to absorb loads imparted on deck by the exerciser.

2. The exercise treadmill of claim 1:

wherein the deck having opposite side portions extending between the first and second end portions of the deck; and further comprising a pivot bracket positioned between each side portion of the deck and the corresponding location on the frame.

3. An exercise treadmill according to claim 2, wherein the frame comprises longitudinal side rails disposed in spaced parallel relationship to each other; and a pivot bracket is mounted to each side rail.

4. The exercise treadmill of claim 3, wherein each pivot bracket comprising a body portion mounted to a corresponding frame side rail, a top flange extending transversely to the body portion and connectable to the deck, wherein the juncture between the top flange and the body portion of the pivot bracket is flexible.

5. The exercise treadmill of claim 4:

wherein the body portion of the pivot bracket comprises an outside side wall and an inside side wall and a transverse wall interconnecting the outside side wall and the inside side wall in spaced parallel relationship to each other, the outside side wall being attached to the frame side rail; and wherein the top flange extends generally transversely from the rear wall.

6. The exercise treadmill of claim 5, wherein the top flange underlies the deck.

7. The exercise treadmill according to claim 5, further comprising a transverse member extending between the outside side wall and the inside side wall at a location spaced from the transverse wall to enhance the rigidity of the body portion of the pivot bracket.

8. The exercise treadmill of claim 1, wherein each pivot bracket comprising a body portion mounted to a corresponding portion of the frame, a top flange extending transversely to the body portion and connectable to the deck, wherein the juncture between the top flange and the body portion of the pivot bracket is flexible.

9. The exercise treadmill of claim 8, wherein the body portion of the pivot bracket comprises an outside side wall and an inside side wall and a transverse wall interconnecting the outside side wall and the inside side wall in spaced parallel relationship to each other, the outside side wall being attached to the frame; and wherein the top flange extends generally transversely from the rear wall.

10. The exercise treadmill of claim 9, wherein the top flange underlies the deck.

11. The exercise treadmill according to claim 9, further comprising a transverse member extending between the outside side wall and the inside side wall at a location spaced from the transverse wall to enhance the rigidity of the body portion of the pivot bracket.

12. The exercise treadmill according to claim 1, further comprising an elevation system to raise and lower the first and second end portions of the deck relative to each other.

13. The exercise treadmill according to claim 12, wherein the elevation system supports the portion of the treadmill frame adjacent the pivot bracket.

14. The exercise treadmill of claim 13, wherein the elevation system includes a pivot wall having an upper edge portion pivotally connected to the frame adjacent pivot bracket to extend generally downwardly therefrom to support the frame, and an actuating link operably coupled to the pivot wall to pivot the pivot wall about the connection between the upper end portion of the pivot wall and the frame, thereby to raise and lower the second end portion of the treadmill deck relative to the first end portion.

15. An exercise treadmill comprising:

(a) a frame;

(b) first and second roller assemblies operably mounted on the frame;

(c) an endless belt trained about the first and second roller assemblies;

(d) a deck disposed between the frame and the upper run of the endless belt, the deck having a first end portion and a second end portion; and (e) a suspension system for suspending the deck on the frame to pivot about a transverse axis adjacent to the second end portion of the deck, the suspension system comprising, at least one pivot bracket to pivotally couple the second end portion of the deck to the frame to pivot the frame about an axis extending generally transversely to the length of the deck, and, at least one elastomeric spring disposed between the frame and the deck at a location between the first and second end portions of the deck to absorb loads imparted on deck by the exerciser.

16. The exercise treadmill of claim 15:

wherein the deck having opposite side portions extending between the first and second end portions of the deck; and, the suspension system further comprising a pivot bracket positioned between each side portion of the deck and the corresponding location on the frame.

17. An exercise treadmill according to claim 16, wherein the frame comprises longitudinal side rails disposed in spaced parallel relationship to each other and a pivot bracket is mounted to each side rail.

18. The exercise treadmill of claim 17, wherein each pivot bracket comprising a body portion mounted to a corresponding frame side rail, a top flange projecting transversely from the body portion and connectable to the deck, wherein the juncture between the top flange and the body portion of the pivot bracket is flexible.

19. The exercise treadmill of claim 18:

wherein the body portion of the pivot bracket comprises an outside side wall and an inside side wall and a transverse wall interconnecting the outside side wall and the inside side wall in spaced parallel relationship to each other, the outside side wall being attached to the frame side rail; and wherein the top flange projects generally transversely from the rear wall.

20. The exercise treadmill according to claim 19, wherein the suspension system further comprising a transverse member extending between the outside side wall and the inside side wall at a location spaced from the transverse wall to enhance the rigidity of the body portion of the pivot bracket.

21. The exercise treadmill according to claim 15, further comprising a lift system to raise and lower the first and second end portions of the deck relative to each other.

22. The exercise treadmill according to claim 21, wherein the lift system supports the portion of the treadmill frame adjacent the pivot bracket.

23. The exercise treadmill of claim 22, wherein the lift system includes a pivot wall having an upper edge portion pivotally connected to the frame adjacent pivot bracket to extend generally downwardly therefrom to support the frame, and an actuating link operably coupled to the pivot wall to pivot the pivot wall about the connection between the upper end portion of the pivot wall and the frame, thereby to raise and lower the second end portion of the treadmill deck relative to the first end portion.

* * * * *

UNITED STATES PATENT AND TRADEMARK OFFICE

CERTIFICATE OF CORRECTION

PATENT NO. : 6,179,753 B1
DATED : January 30, 2001
INVENTOR(S) : P.D. Barker et al.

It is certified that error appears in the above-identified patent and that said Letters Patent is hereby corrected as shown below:

Title page,
Item [56], References Cited, U.S. PATENT DOCUMENTS, insert in appropriate numerical order the following:

| | | |
|---|---|---|
| -- 4,344,616 | 8/1982 | Ogden |
| 4,350,336 | 9/1982 | Hanford |
| 4,423,864 | 1/1984 | Wiik |
| 4,974,831 | 12/1990 | Dunham |
| 4,984,810 | 1/1991 | Stearns et al. |
| 5,184,988 | 2/1993 | Dunham |
| 5,336,144 | 8/1994 | Rodden |
| 5,382,207 | 1/1995 | Skowronski et al. |
| 5,441,468 | 8/1995 | Deckers et al. |
| 5,454,772 | 10/1995 | Rodden |
| 5,476,430 | 12/1995 | Lee et al. |
| 5,484,362 | 1/1996 | Skowronski et al. |
| 5,562,575 | 10/1996 | Gvoich |
| 5,599,259 | 2/1997 | Skowronski et al. |
| 6,013,011 | 1/2000 | Moore et al. -- |

Insert in appropriate order the following:
-- FOREIGN PATENT DOCUMENTS

| | | |
|---|---|---|
| 2616132 | 12/1988 | (FR) |
| 3601-184 | 1/1986 | (DE) |
| 1395344 | 5/1988 | (USSR) |
| A63B 19/00 | 3/1981 | (KR) |
| WO81/01960 | 7/1981 | (JP) |
| WO 97/21471 | 6/1997 | (GB) -- |

Column 1,
Line 54, “from frame” should read -- from the frame --

Column 2,
Line 22, “of pivot” should read -- of the pivot --

Column 3,
Line 15, “frame 12, a forward” should read -- frame 12 and a forward --

UNITED STATES PATENT AND TRADEMARK OFFICE

CERTIFICATE OF CORRECTION

PATENT NO. : 6,179,753 B1 
DATED : January 30, 2001
INVENTOR(S) : P.D. Barker et al.

It is certified that error appears in the above-identified patent and that said Letters Patent is hereby corrected as shown below:

Column 4,
Line 16, "Preferably" should read -- Preferably , --
Line 22, "assembly 16, is housed" should read -- assembly 16 is housed --
Line 29, "of horizontal fins" should read -- of spaced-apart horizontal fins --
Line 47, "comer" should read -- corner --
Line 51, "comers" should read -- corners --
Line 58, "comers" should read -- corners --
Line 60, "comers" should read -- corners --

Column 5,
Line 50, "Ideally" should read -- Ideally, --
Line 57, "can be of" should read -- can be composed of --

Column 6,
Line 56, "robust" should read -- robustly --

Column 7,
Line 22, "on deck" should read -- on the deck --

Column 8,
Line 24, "adjacent pivot" should read -- adjacent the pivot --
Line 54, "on deck" should read -- on the deck --

Column 10,
Line 12, "adjacent pivot" should read -- adjacent the pivot --

Signed and Sealed this

Twenty-third Day of July, 2002

*Attest:*

*Attesting Officer*

JAMES E. ROGAN
*Director of the United States Patent and Trademark Office*